US006693589B2

(12) United States Patent
Boe et al.

(10) Patent No.: US 6,693,589 B2
(45) Date of Patent: Feb. 17, 2004

(54) DIGITAL BEAM STABILIZATION TECHNIQUES FOR WIDE-BANDWIDTH ELECTRONICALLY SCANNED ANTENNAS

(75) Inventors: Eric N. Boe, Long Beach, CA (US); Robert E. Shuman, Torrance, CA (US); Richard D. Young, Lawndale, CA (US); Hoyoung C. Choe, Torrance, CA (US); Adam C. Von, Monterey Park, CA (US)

(73) Assignee: Raytheon Company, Lexington, MA (US)

( * ) Notice: Subject to any disclaimer, the term of this patent is extended or adjusted under 35 U.S.C. 154(b) by 79 days.

(21) Appl. No.: 10/060,781

(22) Filed: Jan. 30, 2002

(65) Prior Publication Data

US 2003/0142015 A1 Jul. 31, 2003

(51) Int. Cl.[7] ..... H01Q 3/22
(52) U.S. Cl. ..... 342/372
(58) Field of Search ..... 342/368–384

(56) References Cited

U.S. PATENT DOCUMENTS

| | | | | | |
|---|---|---|---|---|---|
| 2,225,928 | A | * | 12/1940 | Ring | 342/368 |
| 4,263,600 | A | * | 4/1981 | Williams et al. | 342/372 |
| 4,276,551 | A | * | 6/1981 | Williams et al. | 342/372 |
| 4,586,047 | A | * | 4/1986 | Inacker et al. | 342/372 |
| H173 | H | * | 12/1986 | Claborn et al. | 342/372 |
| 4,670,756 | A | * | 6/1987 | Lopez | 342/372 |
| 5,592,179 | A | * | 1/1997 | Windyka | 342/372 |
| 5,726,662 | A | * | 3/1998 | Hopwood | 342/372 |
| 2001/0045907 | A1 | * | 11/2001 | Rexberg | 342/368 |

* cited by examiner

*Primary Examiner*—Thomas H. Tarcza
*Assistant Examiner*—Fred H. Mull
(74) *Attorney, Agent, or Firm*—Leonard A. Alkov; Glenn H. Lenzen, Jr.

(57) ABSTRACT

Techniques for maintaining beam pointing for an Electronically Scanned Antenna (ESA) as its frequency is varied over a wide frequency bandwidth. A technique uses discrete phase shifters, a number of stored states, and a control methodology for rapidly switching among the states.

13 Claims, 4 Drawing Sheets

DIGITAL BEAM STABILIZATION TECHNIQUES FOR WIDE-BANDWIDTH ELECTRONICALLY SCANNED ANTENNAS

TECHNICAL FIELD OF THE DISCLOSURE

This invention relates to phased-array scanned antennas, and more particularly to techniques for stabilizing the beam as the frequency is varied.

BACKGROUND OF THE DISCLOSURE

It is common practice to design radar waveforms with varying frequency when attempting to measure parameters such as target range. Using an extended RF bandwidth offers enhanced measurement resolution of the range parameter. An example of such an extended RF-bandwidth is that used in the formation of a Synthetic Aperture Radar (SAR) map, where the frequency, which varies linearly within the transmitted pulse, can change by up to 5% or more of the center frequency. FIG. 1 shows an exemplary plot of the frequency of a transmitted pulse as a function of time. This is also known as a "chirped" pulse waveform.

As the frequency changes during a pulse, the direction of beam pointing will also change. Hence, a problem to which this invention is addressed is that of beam stabilization for a system employing a frequency-varying waveform such as a chirped pulse waveform.

Known beam stabilization techniques have used spinning analog phase shifters or time delay units. The spinning phase shifters are expensive, heavy, slow to reprogram for new beam pointing positions, and are of limited power handling capability. The time delay units are expensive, bulky, heavy, and suffer from grating lobe formation.

SUMMARY OF THE DISCLOSURE

A method is described for maintaining beam pointing (also known as stabilizing) for an Electronically Scanned Antenna (ESA) as its frequency is varied over a wide frequency bandwidth. The technique uses discrete phase shifters, a number of stored states, and a control methodology for rapidly switching among the states, e.g. within a pulse.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Beam stabilization is used in accordance with an aspect of the invention to maintain the beam pointing on a target while changing frequencies over a wide frequency band. As noted above, wide bandwidth, frequency-varying (chirped) waveforms are in common use, e.g., in the making of Synthetic Aperture Radar (SAR) maps, with the achievable resolution directly proportional to the chirp bandwidth.

Chirped waveform systems represent an exemplary application in which a technique in accordance with the invention can be employed. This technique allows for maintaining the required beam pointing over very wide bandwidths by re-pointing the beam within a pulse.

Figure 1:
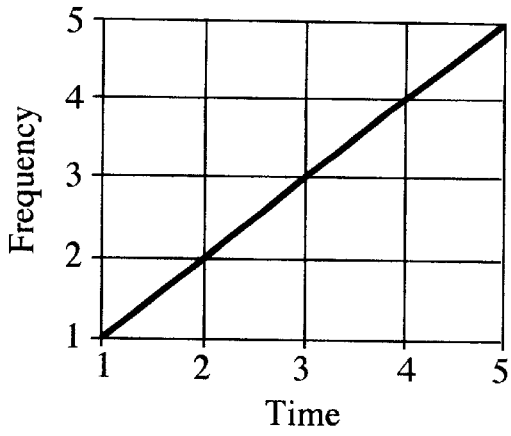
FIG. 1 shows an exemplary plot of the frequency of a transmitted pulse as a function of time for a "chirped" pulse waveform.
Figure 2:
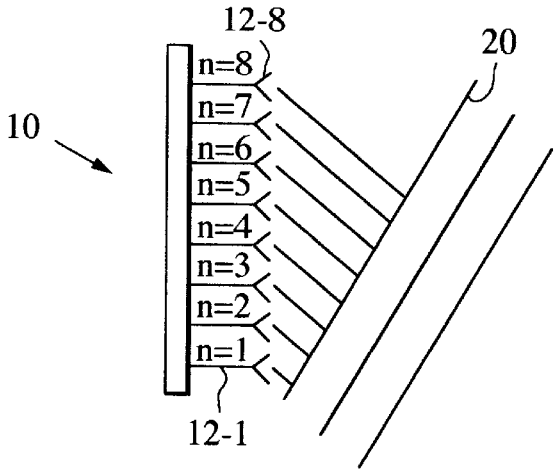
FIG. 2 illustrates an ESA receiving a plane wave.

An ESA antenna is a form of an antenna system that can control the direction of its peak sensitivity by controlling the phase of its radiating/receiving elements to compensate for the received phases of a plane wave from a particular direction or to direct a transmitted beam in a desired direction. FIG. 2 schematically illustrates an ESA 10 receiving a plane wave 20. The phase correction for a transmitting/receiving element 12-1 . . . 12-8 is given by the equation:

$$phi=2*pi*n*d*\sin(theta)/lambda$$

where:

n=element position
d=element spacing
theta (θ)=scan angle
lambda (λ)=wavelength

It can be observed that when frequency changes, a fixed phase correction will result in a different scan angle. This is referred to as beam squint or wander. Repointing the beam back to the original scan angle requires the use of a new set of phase corrections. This process is referred to as beam stabilization.

A simple example follows:

n=element position=1
d=element spacing=0.5"
theta=scan angle=30 degrees
For f1, lambda (λ)=wavelength=1"
For f2, lambda (λ)=wavelength=1.2"

For *f*1, phi=2*pi*1*0.5*sin(30)/1=0.5*pi

For *f*2, phi=2*pi*1*0.5*sin(30)/1.2=0.417*pi

If the phi correction for f1 were used for f2, the result would be a scan angle of 36.8 degrees i.e., an error of 6.8 degrees.

In accordance with an aspect of the invention, a phase shifter device having a set of discrete phase shift values is placed behind each element of an array antenna. The phase shifter devices are sometimes referred to as "digital phase shifters" and are commanded to a desired one of the discrete phase shift values by a control signal, which can be a multi-bit digital value. Phase shifting devices capable of rapid state changes and suitable for the purpose are known in the art and commercially available. Such devices can be fabricated as gallium arsenide MMIC chips, in one implementation. An active ESA system which employs suitable phase shifting devices is the APG-63(V)2 active electronically scanned array radar system of the U.S. government.

Changing the state of the phase shifting devices 30 gives the "steering" effect of an ESA. In one embodiment, the phase shifting devices are each controlled by a corresponding control circuit associated with the phase shifting device. The control circuit can in one embodiment calculate the required phase state for a given beam pointing angle in real time. Alternately, the control circuit can read a pre-computed required phase state for each phase shifter corresponding to a given frequency and beam pointing angle from a local or remote memory, e.g. in a look-up table. In a further alternate embodiment, the control circuit can respond to a control signal to set the phase shifting device to a state next in a stored sequential order.

Figure 3:
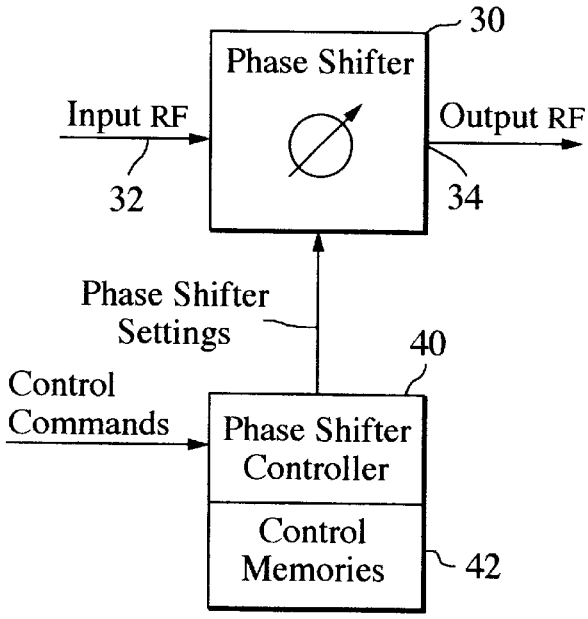
FIG. 3 depicts a phase shifting device with an associated controller and memory in accordance with an aspect of the invention.

FIG. 3 depicts a phase shifting device 30 with associated controller 40 and memory 42. The phase shifting device has an input RF port 32 and an RF output port 34. The phase shifter device is coupled to the control circuit 40, i.e. a control device, for the phase shifter, and the memory 42 to contain the required phase states. A "control commands" line 44 is also depicted in FIG. 2, and carries the commands which command the control circuit 40 to execute the appropriate phase state. The "control commands" line is coupled to a beam steering controller or array controller for the ESA.

A further function for the multiple-memory beam stabilization technique is that of commanding the phase shifter control device to execute the next phase state. A simple control line 42 is depicted in FIG. 3. This line can be used as an asynchronous discrete control, forcing the control circuit 40 to read the next phase state from memory 42 and send the appropriate commands to the phase shifter 30.

A second control approach is for the control line 42 to carry a clock signal. The phase shifter controller 40 in this alternate embodiment can use an internal clock and cycle to the next memory state, i.e. defining the next phase shifting state, after a pre-determined number of clocks had passed.

A third, and more flexible, control approach is for the line to be a serial data line containing control and data commands. The contents of the data commands can be loaded into the local memory by the control device 40. Control commands result in the control device accessing the specified memory and commanding the phase shifter to the desired state. Additional control schemes can readily be devised by those skilled in the art.

One aspect is to provide each phase shifting device with its own dedicated control device and memory. This enables much faster performance, since the separate control devices can be rapidly commanded to execute a next phase state. This speed of operation is important in a chirped waveform application, since an ESA employing the invention may have hundreds or even thousands of radiating elements, each with its own phase shifting device. The processing load is therefor distributed, allowing the individual phase shifting devices to be rapidly commanded to new phase states during a chirped pulse, and thereby provide beam stabilization. Such rapid re-setting of the phase shifting devices for many applications could not be performed by a conventional array controller which controls the beam steering phase shifting devices, which simply would not be capable of handling the processing load and issuing the necessary commands to achieve beam stabilization for a large ESA in real time. Of course, as the power and speed of array controllers advances, and for smaller, simpler arrays, the array controller could be employed to directly generate phase shifting device commands to not only steer the beam but achieve beam stabilization within a pulse of a chirped waveform.

Figure 4:
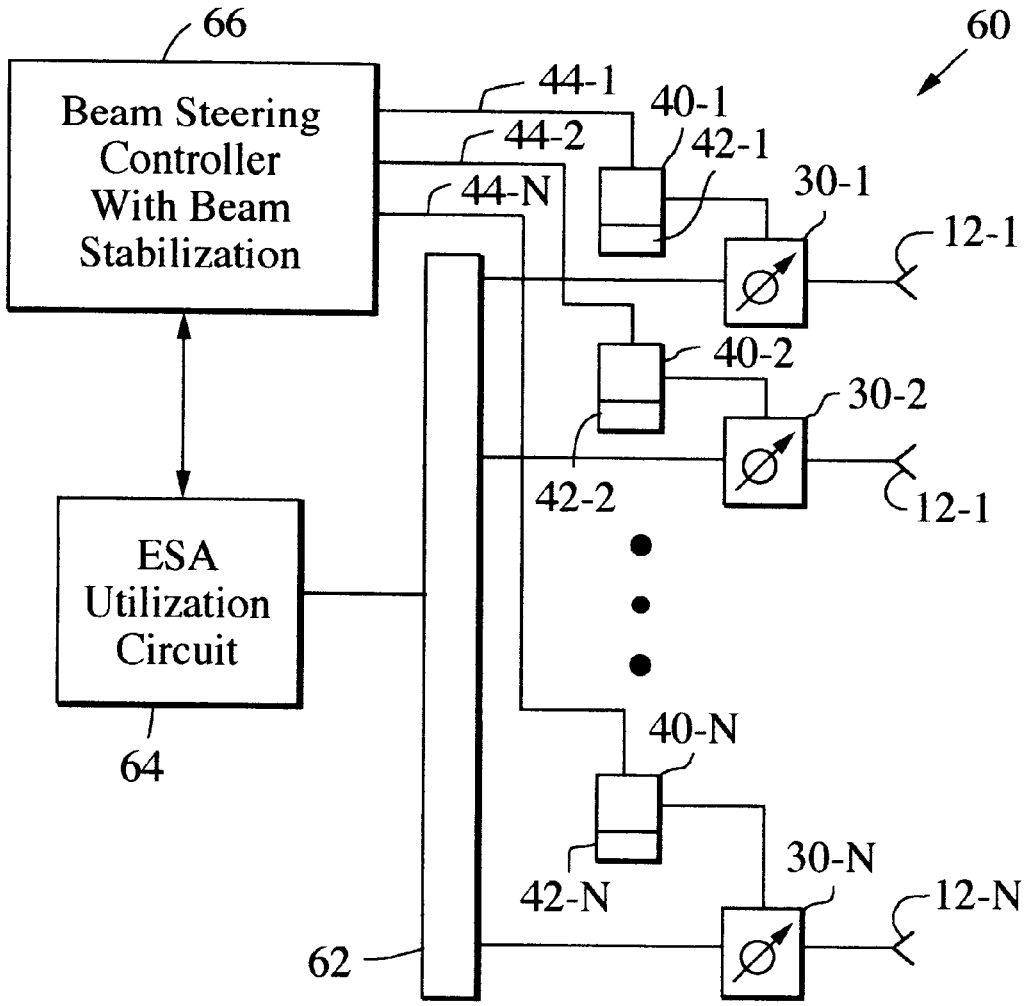
FIG. 4 is a simplified schematic diagram of an ESA embodying aspects of the invention.

FIG. 4 is a simplified schematic diagram of an ESA 60 embodying aspects of the invention. The ESA includes a plurality of radiating elements 12-1, 12-2, . . . 12-N, each of which is connected to a corresponding phase shifting device 30-1, 30-2, . . . 30-N. The phase shifting devices couple each radiating element to a feed network generally indicated as network 62. The network 62 can be a combiner/divider circuit for combining the phase shifted contributions received at the elements 12-1, 12-2, . . . 12-N to provide an array signal to utilization circuit or device 64, or for dividing a transmit signal from device 64 into separate components for each radiating element. Such networks are well known in the art.

Associated with each phase shifting device 12-1, 12-2, . . . 12-N is a corresponding control device 40-1, 40-2, 40-N and memory 40-1, 40-2, . . . 40-N, as described above regarding FIG. 3. Respective "control commands" lines 44-1, 44-2, . . . 44-3 connect the respective control devices to a beam steering controller 66 with beam stabilization, although a single clock line or data bus can alternatively be employed.

The beam steering controller 66 generates the commands to stabilize the beam by adjusting the phase shift settings for the phase shifting devices to compensate for changes in frequency within a pulse, e.g. using a chirped pulse waveform.

This invention is well suited to phased-array antennas, such as active electronically scanned arrays. It is of particular interest to wide-bandwidth applications, such as mapping (SAR) and electronic surveillance (ESM). Space-based applications requiring wide bandwidth are particularly well suited.

This technique of beam stabilization is particularly suitable to high power applications, such as those using active ESA technology. That is because the transmit/receive modules used in active ESAs typically perform their phase shifting functions before final power amplification. Thus, the phase shifting devices for such active ESA applications can be designed to withstand much lower power levels, and take up less space.

This technique of beam stabilization also allows for a lighter, more compact implementation of beam stabilization than offered by the use of time delay units. This is of particular interest to space-based applications where weight is a primary design driver.

Figure 5A:
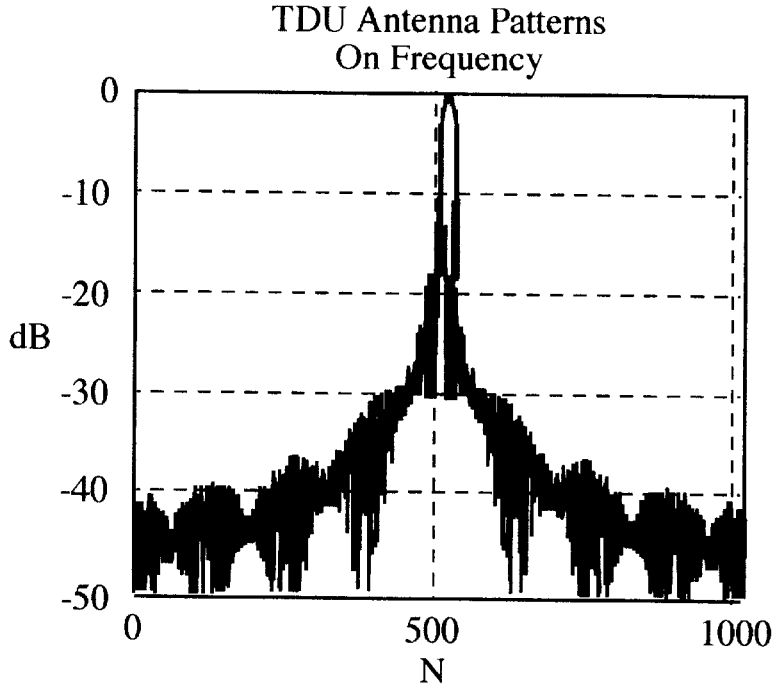
FIG. 5A shows an antenna pattern for an antenna using time delay units behind each of eight 125 element subarrays, when chirping on frequency, with the grating lobes falling into nulls.
Figure 5B:
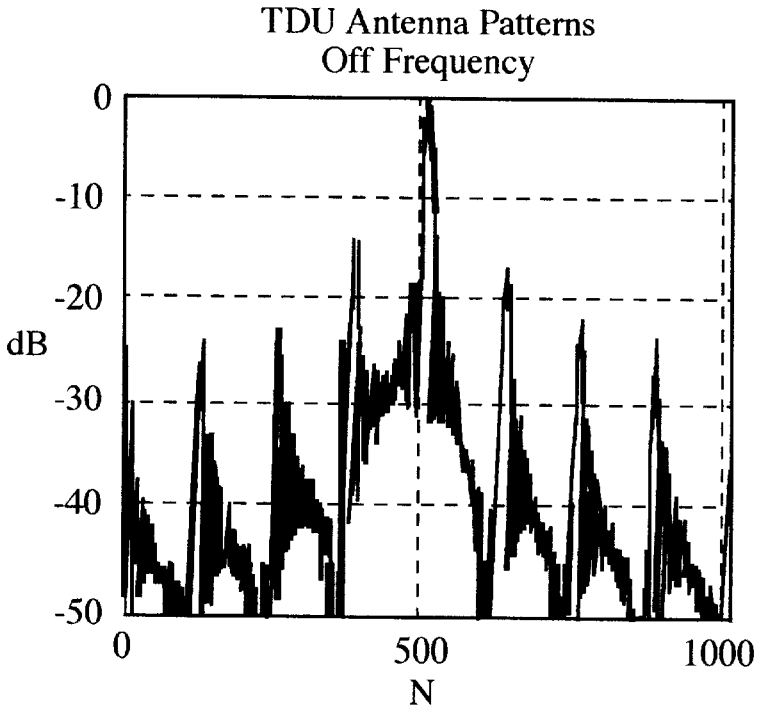
FIG. 5B illustrates an antenna pattern for the same antenna, but when chirping off frequency, showing the formation of grating lobes.
Figure 6A:
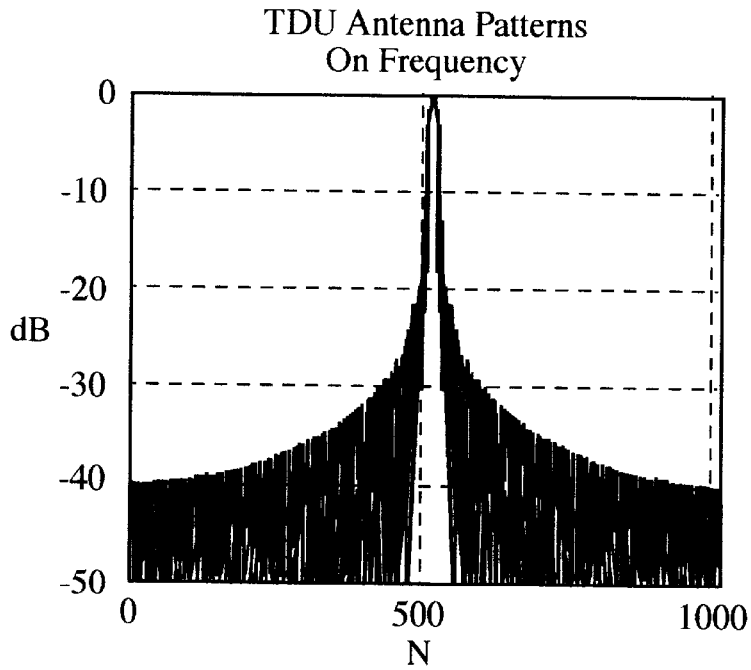
FIGS. 6A and 6B show an antenna pattern for an antenna of eight 125 element subarrays, using digital beam stabilization techniques in accordance with an aspect of the invention, when chirping on-frequency and off-frequency, respectively.
Figure 6B:
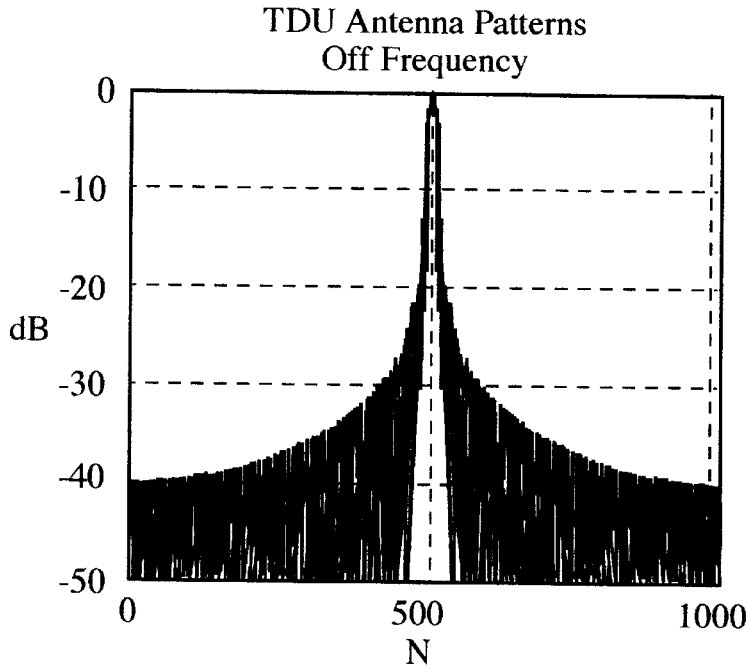

The technique also has a performance advantage over the use of time delay units in that no grating lobes are formed during the chirped pulse. FIGS. 5A–5B show the resultant pattern of an antenna using time delay units behind each of eight 125-element subarrays, each of which forms a beam that does wander with frequency. Taken individually, each of the subarrays has a very wide bandwidth, a result of which is that the beam stays on the target throughout the chirped waveform. The subarrays are combined with the time delay units adding the appropriate phase shift such that the combined antenna has both the benefit of a narrow main lobe and beam stability which keeps the beam on target. On frequency, shown in FIG. 5A, the grating lobes fall into nulls, but quickly appear when chirping off frequency (FIG. 5B). FIGS. 6A–6B show an antenna pattern both on-frequency (FIG. 6A) and off-frequency (FIG. 6B) for the digital beam stabilization technique in accordance with this invention.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for maintaining beam pointing for an electronically scanned antenna (ESA) employing a chirped pulse waveform wherein its frequency is varied over a wide frequency bandwidth within a pulse, comprising:

for radiating elements comprising the ESA, each radiating element having an associated phase shifter having only a discrete set of available phase shift values, setting the respective phase shifters to values for steering the ESA beam to a desired pointing direction for a first frequency in the frequency bandwidth during the pulse;

changing the operating frequency of the ESA in the frequency bandwidth during the pulse;

applying a set of phase corrections to the respective phase shifters to compensate for the change in frequency to maintain the ESA beam pointing direction during the pulse;

for at least some subsequent changes in the operating frequency within the pulse, applying a corresponding set of phase corrections to compensate for the frequency changes to maintain the ESA beam pointing direction during the pulse.

2. The method of claim 1, further including storing a set of phase correction values for each radiating element and for respective discrete operating frequencies, and wherein said step of applying a set of phase corrections includes:

for a corresponding operating frequency, retrieving a corresponding set of phase corrections and applying said phase corrections to said phase shifters.

3. The method of claim 1, further including storing a set of sequential phase shift correction values for each phase shifter, and wherein the step of applying a set of phase corrections includes:

applying a clock signal to a phase shift controller and periodically retrieving a phase shift value next in order.

4. The method of claim 1, wherein said step of applying a set of phase shift corrections includes:

sending a data command to each phase shifter to command the phase shifter to apply an appropriate phase correction.

5. An electronically scanned array (ESA) antenna employing a chirped pulse waveform, wherein the waveform frequency is varied within the pulse over a wide frequency bandwidth, comprising:

a set of radiating elements;

a set of phase shifters, each having only a discrete set of phase shifts, each radiating element having an associated one of said phase shifters;

a control system for setting the respective phase shifters to values for steering an ESA beam to desired pointing directions for frequencies in the frequency bandwidth within a pulse, and for applying sets of phase corrections to the respective phase shifters to compensate for changes in frequency to substantially maintain the ESA beam pointing direction within each pulse.

6. The antenna of claim 5, wherein the control system includes, for each phase shifter, a controller and a memory for storing a plurality of phase states.

7. The antenna of claim 5, further including a memory system for storing a set of phase correction values for each radiating element, and wherein said control system is adapted to retrieve and apply, for a corresponding operating frequency, a corresponding set of phase corrections.

8. The antenna of claim 5, further including a set of memories, one of said memories for each phase shifter for storing a set of sequential phase shift correction values for each phase shifter, and a set of phase shift controllers, one of said phase shift controllers associated with a corresponding phase shifter, and wherein the control system is adapted to apply a clock signal to said set of phase shift controllers, each of the set of phase shift controllers periodically retrieving a phase shift value next in order from a corresponding memory and applying said phase shift value to a corresponding phase shifter.

9. The antenna of claim 5, wherein said control system is adapted to send a data command to each phase shifter to command the phase shifter to apply an appropriate phase correction for a given frequency and ESA beam pointing direction.

10. The antenna of claim 5, wherein each of said set of phase shifters comprises an MMIC phase shifter.

11. An electronically scanned array (ESA) antenna employing a chirped pulse waveform, wherein the waveform frequency is varied within the pulse over a wide frequency bandwidth, comprising:

a set of radiating elements;

a set of phase shifters, each having only a discrete set of phase shifts, each radiating element having an associated one of said phase shifters;

a beam steering system for setting the respective phase shifters to values for steering an ESA beam to desired pointing directions;

a beam stabilization circuit for compensating for frequency changes within a pulse to maintain a beam pointing direction during the pulse, said circuit applying sets of phase corrections to the respective phase shifters to compensate for changes in frequency to substantially maintain the ESA beam pointing direction within each pulse.

12. The antenna of claim 11, wherein the beam stabilization circuit includes, for each phase shifter:

a memory for storing a plurality of stored phase states; and a phase shift control circuit responsive to a phase shift control signal for retrieving and applying to said phase shifter respective ones of the stored phase states.

13. The antenna of claim 11, wherein each of said set of phase shifters comprises an MMIC phase shifter.

* * * * *